US006971346B2

(12) United States Patent
Flohr

(10) Patent No.: US 6,971,346 B2
(45) Date of Patent: Dec. 6, 2005

(54) SYSTEM FOR CONTROLLING ELECTROMECHANICAL VALVES IN AN ENGINE

(75) Inventor: Gary Flohr, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/804,494

(22) Filed: Mar. 18, 2004

(65) Prior Publication Data

US 2005/0205026 A1 Sep. 22, 2005

(51) Int. Cl.[7] ..... F01L 9/04

(52) U.S. Cl. ..... 123/90.11; 123/90.15; 123/90.24; 251/129.07; 251/129.09; 251/129.15; 251/129.16; 251/129.18; 335/266; 335/268; 335/269; 361/159; 361/189; 323/259; 323/344

(58) Field of Search ..... 123/90.11, 90.15, 123/90.24; 251/129.07, 129.09, 129.15, 129.16, 251/129.18; 335/220, 266, 268, 269; 361/159, 361/189, 301.1, 328; 323/259, 344

(56) References Cited

U.S. PATENT DOCUMENTS 5,532,526 A * 7/1996 Ricco et al. ..... 307/104
5,775,276 A * 7/1998 Yanai et al. ..... 123/90.11
5,804,962 A 9/1998 Kather et al.
5,915,347 A * 6/1999 Yanai et al. ..... 123/90.11
6,175,484 B1 * 1/2001 Caruthers et al. ..... 361/159
6,201,681 B1 3/2001 Torii et al.
6,276,318 B1 * 8/2001 Yanai et al. ..... 123/90.11
6,363,895 B1 4/2002 Butzmann et al.
6,626,146 B1 9/2003 Yanai et al.
6,631,067 B2 * 10/2003 Newton et al. ..... 361/154
6,772,737 B2 * 8/2004 Gaessler et al. ..... 123/490
2002/0104494 A1 8/2002 Ozawa et al.

FOREIGN PATENT DOCUMENTS

DE 19701471 7/1998
EP 1010867 12/1999

* cited by examiner

*Primary Examiner*—Thomas Denion
*Assistant Examiner*—Kyle M. Riddle
(74) *Attorney, Agent, or Firm*—Allan J. Lippa

(57) ABSTRACT

A system for electronically actuating valves in an engine. The system includes a first voltage source, a second voltage source, and plural valve actuator subsystems coupled between the first voltage source and the second voltage source. Each valve actuator subsystem has a valve actuator and a switch. One of the actuator subsystems is configured so that current flows from the first voltage source through the valve actuator of the subsystem when the switch is in a first position, and when the switch is in a second position, current is permitted to flow from the valve actuator toward the second voltage source. Another of the valve actuator subsystems is configured so that current flows from the second voltage source through the valve actuator of the subsystem when the switch is in a first position, and when the switch is in a second position, current is permitted to flow from the valve actuator toward the first voltage source.

24 Claims, 4 Drawing Sheets

SYSTEM FOR CONTROLLING ELECTROMECHANICAL VALVES IN AN ENGINE

FIELD OF THE INVENTION

The present invention relates generally to systems for actuating valves in a camless engine.

BACKGROUND AND SUMMARY OF THE INVENTION

Electronic or electromagnetic valve actuation (EVA) systems can be used in internal combustion engines to provide increased flexibility in terms of valve timing and/or lift, rather than being constrained by camshaft actuation. Such systems commonly include an electromagnetic actuator coil, which is energized with a current to generate an electromotive force for moving the valve and holding it in a desired position.

Existing EVA systems have certain disadvantages, depending on the setting in which they are used. One disadvantage relates to the need to provide a circulation path for freewheel current generated by the actuator coil after being energized (e.g., through application of a supply voltage). Typically, providing a circulation path for freewheel current requires multiple switches and other components for each actuator coil, which increases manufacturing costs. For example, prior systems have employed a half bridge topology to allow for freewheel current circulation. The half bridge topology allows freewheel current from an actuator coil to flow through two freewheel diodes into a power bridge bus. To energize actuator coils and provide freewheel current circulation, the half bridge design requires two discrete MOSFET switches and two discrete diodes per actuator coil. Another disadvantage is that many existing systems are inefficient in their inability to make use of the energy dissipated through freewheel currents.

The above disadvantages may be overcome by the system of the present description, which according to one aspect, comprises: a system for electronically actuating valves in an engine. The system includes a first voltage source, a second voltage source, and plural valve actuator subsystems coupled between the first voltage source and the second voltage source. Each valve actuator subsystem has a valve actuator and a switch. One of the actuator subsystems is configured so that current flows from the first voltage source through the valve actuator of the subsystem when the switch is in a first position, and when the switch is in a second position, current is permitted to flow from the valve actuator toward the second voltage source. Another of the valve actuator subsystems is configured so that current flows from the second voltage source through the valve actuator of the subsystem when the switch is in a first position, and when the switch is in a second position, current is permitted to flow from the valve actuator toward the first voltage source.

BRIEF DESCRIPTION OF THE FIGURES

The above features and advantages will be readily apparent from the following detailed description of an example embodiment of the invention, or from the accompanying drawings.

DETAILED DESCRIPTION OF EXAMPLE EMBODIMENT(S) OF THE INVENTION

Figure 1:
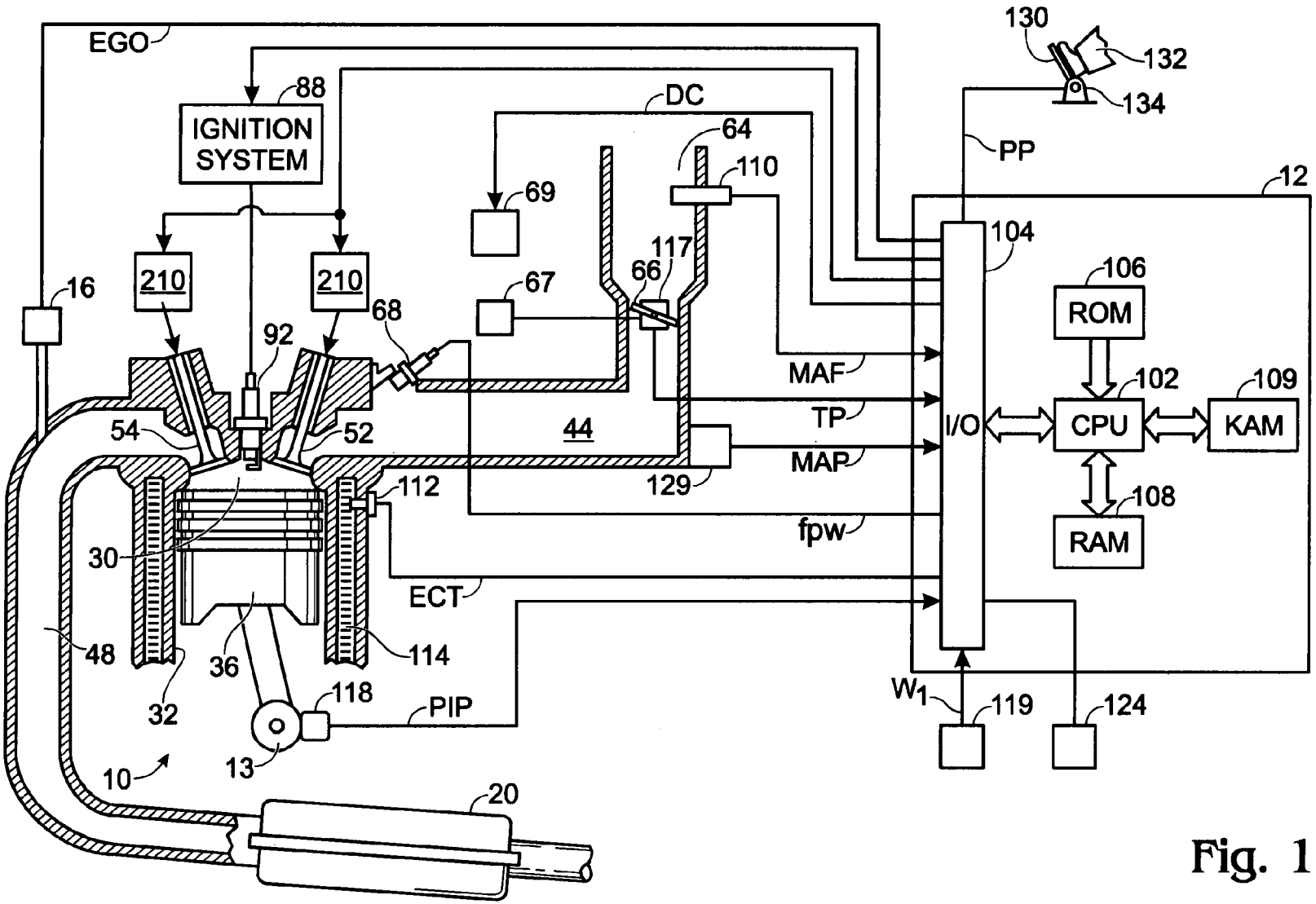
FIG. 1 is a block diagram of an engine illustrating various components related to the present invention.

Referring to FIG. 1, internal combustion engine 10 is shown. Engine 10 can be an engine of a passenger vehicle or truck driven on roads by drivers. Although not shown, Engine 10 can be coupled into a powertrain system of the vehicle. The powertrain can include a torque converter coupled to the engine 10 via a crankshaft. The torque converter can also be coupled to an automatic transmission via a turbine shaft. The torque converter can have a bypass clutch, which can be engaged, disengaged, or partially engaged. When the clutch is either disengaged or partially engaged, the torque converter is said to be in an unlocked state. The turbine shaft is also known as transmission input shaft. The transmission can comprise an electronically controlled transmission with a plurality of selectable discrete gear ratios. The transmission can also comprise various other gears such as, for example, a final drive ratio. The transmission can also be coupled to tires via an axle. The tires interface the vehicle to the road.

Internal combustion engine 10 comprising a plurality of cylinders, one cylinder of which, shown in FIG. 1, is controlled by electronic engine controller 12. Engine 10 includes combustion chamber 30 and cylinder walls 32 with piston 36 positioned therein and connected to crankshaft 13. Combustion chamber 30 communicates with intake manifold 44 and exhaust manifold 48 via respective intake valve 52 and exhaust valve 54. Exhaust gas oxygen sensor 16 is coupled to exhaust manifold 48 of engine 10 upstream of catalytic converter 20. In one example, converter 20 is a three-way catalyst for converting emissions during operation about stoichiometry.

As described more fully below with regard to FIGS. 2A, 2B and 3, at least one of, and potentially both, of valves 52 and 54 are controlled electronically via apparatus 210 and/or system 310.

Intake manifold 44 communicates with throttle body 64 via throttle plate 66. Throttle plate 66 is controlled by electric motor 67, which receives a signal from ETC driver 69. ETC driver 69 receives control signal (DC) from controller 12. In an alternative embodiment, no throttle is utilized and airflow is controlled solely using valves 52 and 54. Further, when throttle 66 is included, it can be used to reduce airflow if valves 52 or 54 become degraded, or if vacuum is desired to operate accessories or reduce induction related noise.

Intake manifold 44 is also shown having fuel injector 68 coupled thereto for delivering fuel in proportion to the pulse width of signal (fpw) from controller 12. Fuel is delivered to fuel injector 68 by a conventional fuel system (not shown) including a fuel tank, fuel pump, and fuel rail (not shown).

Engine 10 further includes conventional distributorless ignition system 88 to provide ignition spark to combustion chamber 30 via spark plug 92 in response to controller 12. In the embodiment described herein, controller 12 is a conventional microcomputer including: microprocessor unit 102, input/output ports 104, electronic memory chip 106, which is an electronically programmable memory in this particular example, random access memory 108, and a conventional data bus. Further, keep alive memory (KAM) 109 is shown communicating with the CPU 102.

Controller 12 receives various signals from sensors coupled to engine 10, in addition to those signals previously discussed, including: measurements of inducted mass air flow (MAF) from mass air flow sensor 110 coupled to throttle body 64; engine coolant temperature (ECT) from temperature sensor 112 coupled to cooling jacket 114; a measurement of manifold pressure (MAP) from MAP sensor 129, a measurement of throttle position (TP) from throttle position sensor 117 coupled to throttle plate 66; a measurement of transmission shaft torque, or engine shaft torque from torque sensor 124, a measurement of turbine speed (W1) from turbine speed sensor 119, where turbine speed measures the speed of the turbine shaft (output of a torque converter, if equipped), and a profile ignition pickup signal (PIP) from Hall effect sensor 118' coupled to crankshaft 13 indicating an engine speed (N) and position. Alternatively, turbine speed may be determined from vehicle speed and gear ratio.

Continuing with FIG. 1, accelerator pedal 130 is shown communicating with the driver's foot 132. Accelerator pedal position (PP) is measured by pedal position sensor 134 and sent to controller 12.

In an alternative embodiment, where an electronically controlled throttle plate is not used, an air bypass valve (not shown) can be installed to allow a controlled amount of air to bypass throttle plate 66. In this alternative embodiment, the air bypass valve (not shown) receives a control signal (not shown) from controller 12.

Figure 2B:
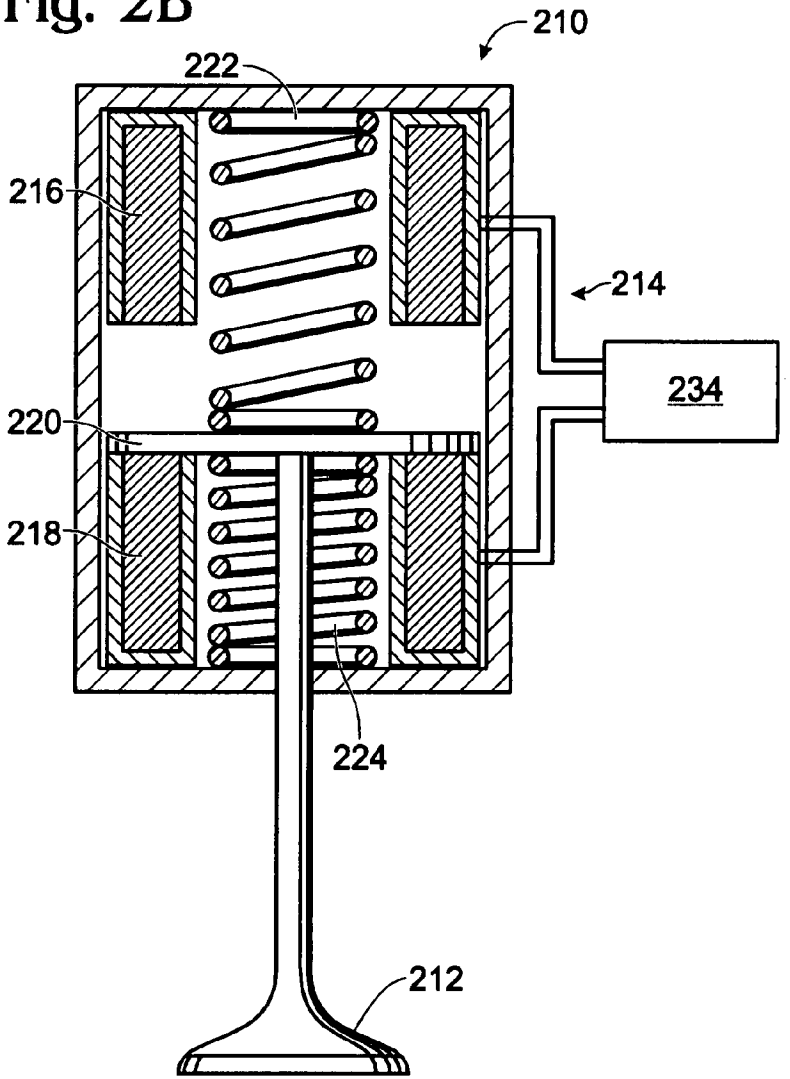
FIG. 2B shows a schematic vertical cross-sectional view of an apparatus for controlling valve actuation, with the valve in the fully open position.
Figure 2A:
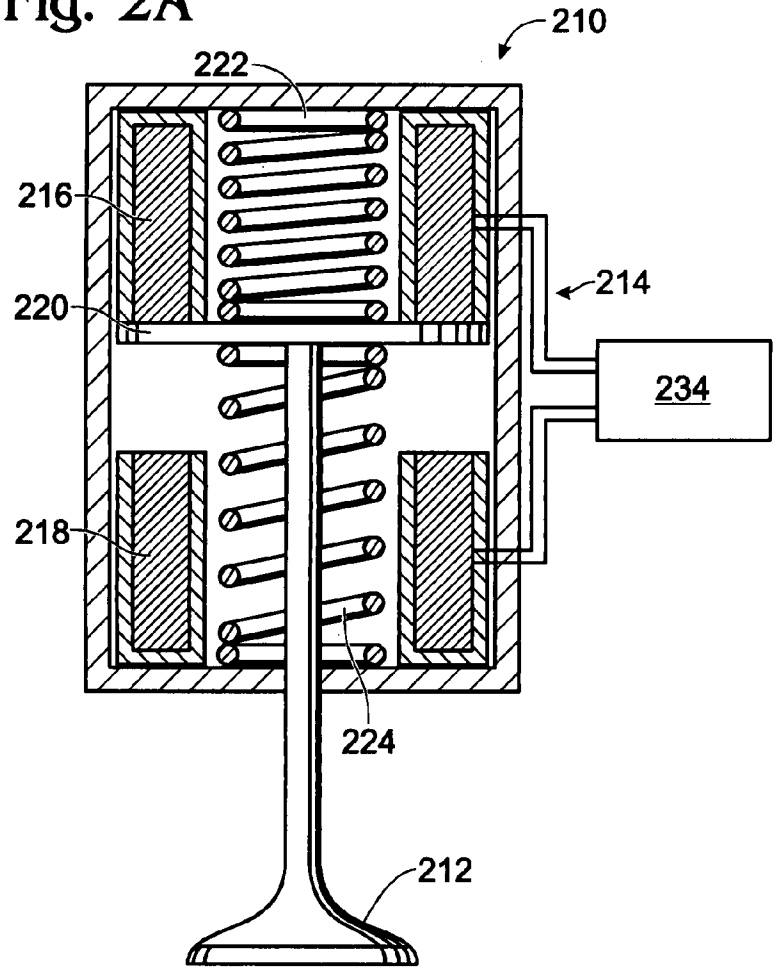
FIG. 2A shows a schematic vertical cross-sectional view of an apparatus for controlling valve actuation, with the valve in the fully closed position.

Referring to FIGS. 2A and 2B, an apparatus 210 is shown for controlling movement of a valve 212 in camless engine 10 between a fully closed position (shown in FIG. 2A), and a fully open position (shown in FIG. 2B). The valve 212 can be either or both of intake and exhaust valves 52 and 54 of FIG. 1. Also, if more than one intake and/or exhaust valve are used, such as in a 3-valve, or 4-valve engine, some or all of the valves can be electronically actuated as shown in FIGS. 2A and 2B.

The apparatus 210 includes an electromagnetic valve actuator (EVA) 214 with a controller 234 and upper and lower coils 216, 218 which electromagnetically drive an armature 220 against the force of upper and lower springs 222, 224 for controlling movement of the valve 212.

Switch-type position sensors (not shown) may be provided and installed so that they switch when the armature 220 crosses the sensor location. It is anticipated that switch-type position sensors can be easily manufactured based on optical technology (e.g., LEDs and photo elements) and when combined with appropriate asynchronous circuitry they would yield a signal with the rising edge when the armature crosses the sensor location. It is furthermore anticipated that these sensors would result in cost reduction as compared to continuous position sensors, and would be reliable.

Controller 234 (which can be combined into controller 12, or act as a separate controller) may be operatively connected to the position sensors, and to the upper and lower coils 216, 218 in order to control actuation and landing of the valve 212.

When multiple position sensors are provided, typically a first position sensor is located around the middle position between the coils 216, 218, a second sensor is located close to the lower coil 218, and a third sensor is located close to the upper coil 216. In addition, controller 234 may receive information from other sensors.

Due to the electronic control used above, it is possible to independently actuate cylinder valves operating in an internal combustion engine. This allows increased flexibility to directly control individual cylinder charge characteristics to yield desired torque and emissions output from the engine at various operating modes including variable displacement and variable stroke modes. As indicated above, the electronically actuated valve system can independently actuate the valves, or groups of valves, in the valvetrain to desired valve timings that are computed in an engine control unit (ECU) 12 and delivered to valve actuation controller (VAC) 234. Further, the desired valve timings can be desired valve opening timing, desired valve closing timing, desired valve opening duration, desired valve overlap, or various others.

In some cases, it may be desirable to employ permanent magnets in connection with coils 216 and 218. Permanent magnets may be used, for example, at the lower end of upper coil 216 in an area close to the upper point of armature travel (FIG. 2A), and/or at the upper end of lower coil 218 in an area close to the low point of armature travel (FIG. 2B). In certain settings, such use of permanent magnets may increase the electromagnetic force obtained for a given coil current and improve control of armature speed.

Figure 3:
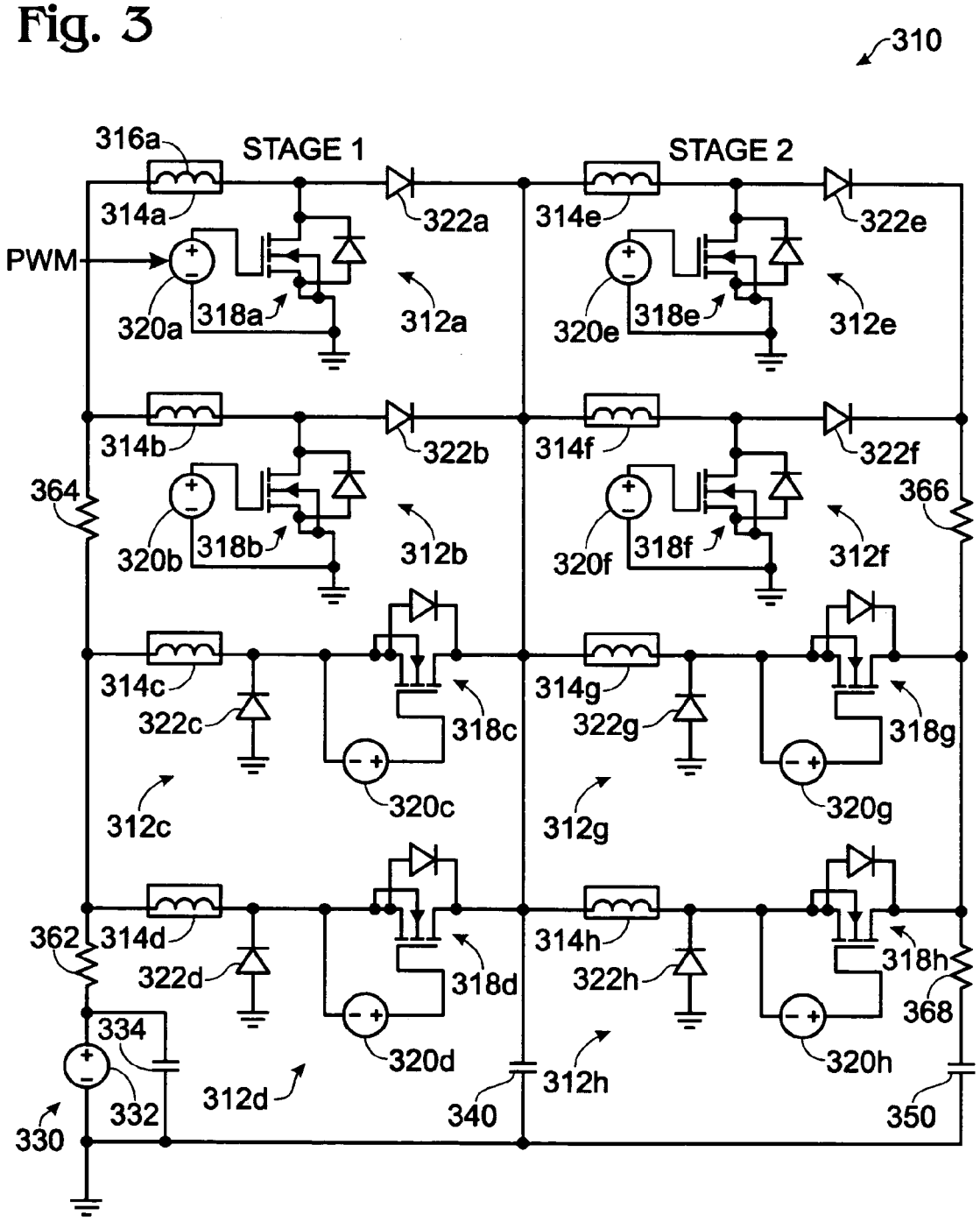
FIG. 3 is a schematic diagram showing a system for electronically controlling valve actuation, which may be implemented in connection with the components and apparatuses of FIGS. 1, 2A and 2B.

FIG. 3 depicts an exemplary system 310 that may be used to control operation of valves in an internal combustion engine, as described above. In particular, referring to FIGS. 1, 2A and 2B, system 310 may incorporate within EVA actuator 214 and/or engine controller 12.

As shown in FIG. 3, system 310 includes several single-switch designs 312 (individually designated as 312*a*, 312*b*, etc. through 312*h*), which may also be referred to as valve actuator drivers or subsystems. The valve actuator subsystems may be configured in multiple stages, so as to allow freewheel current from one stage to feed another stage or stages. As will be discussed in more detail below, subsystems 312*a*, 312*b*, 312*c* and 312*d* form a first stage of subsystems in the depicted example, while subsystems 312*e*, 312*f*, 312*g* and 312*h* form a second stage.

The valve actuator subsystems of the depicted example each include a number of common elements, which are referred to with like designators and a letter corresponding to the particular subsystem. For example, each subsystem includes a valve actuator 314. For valve actuator subsystem 312*a*, the corresponding valve actuator is designated as valve actuator 314*a*; for subsystem 312*b*, the valve actuator is designated as valve actuator 314*b*, and so on. When referring generally to a component shown in more than one subsystem, the letter designator will be omitted.

As shown in the example, each valve actuator subsystem includes a valve actuator 314, which typically includes an actuator coil 316. The coil can be any of the coils used to open and/or close cylinder valves of an internal combustion engine, such as the coils 216, 218 used to move valve 212 in FIGS. 2A and 2B. Each actuator subsystem also includes a switch 318 (e.g., a MOSFET) controlled by a source 320 under pulse-width modulation (PWM) control, and a freewheel diode 322. PWM control is used to regulate coil current when the actuated valve is being held in a desired position (e.g., against the force of spring 222 or 224). For clarity, the PWM control signal is shown only for driver/subsystem 312*a*. Switch 318 in each subsystem is coupled within a charging or energizing current path of the subsystem, while freewheel diode 322 is coupled within a freewheel current path of the subsystem. These paths may be selectively enabled through operation of switch 318, as will be discussed in more detail below.

The valve actuation subsystems of the first stage are coupled between a first energy storage device 330, which may include a power supply 332 and capacitor 334 in parallel with supply 332, and a second energy storage device such as capacitor 340. The second stage valve actuation subsystems are coupled between capacitor 340 and a third energy storage device such as capacitor 350. The energy storage devices typically are selected so as to provide predetermined supply voltages during operation of system 310. The supply voltages create desired regulated voltages across the stages, as will be explained more fully below. For example, in the depicted exemplary system, the components are selected so that during run-time normal operation, energy storage device 330 is at 21 volts, energy storage device 340 is at 42 volts, and energy storage device 350 is at 84 volts, though other voltages may be employed. The second stage voltage drop in the example is twice the first stage voltage drop, so as to yield actuator currents that provide actuator turn-off rates that are the same for each stage.

The general operation of each valve actuation subsystem is as follows: first, valve actuation is initiated by closing switch 318. This enables a charging current pathway through actuator 314 and the closed switch. Current rises through the actuator (e.g., through coils 216, 218 of FIGS. 2A and 2B) to a desired level, which typically is selected based on a predetermined closing or opening force for the valve. Current is driven through the actuator as a result of an applied voltage from a supply voltage provided by one of energy storage devices 330, 340 or 350. Various current sense resistors 362, 364, 366 and 368 may be provided to measure current through the actuators 314. When the current reaches a desired level corresponding to a desired force upon armature 220, switch 318 opens and closes rapidly as a result of a PWM control signal applied to supply 320. The PWM control regulates the coil current in order to provide sufficient force to hold the valve in position. When it is time for the coil to be deactivated, switch 318 remains open.

As discussed above, when switch 318 is closed, the voltage applied by one of energy storage devices 330, 340 or 350 causes an energizing or charging current to be driven through the actuator, and through an energizing current pathway in which the switch is coupled. When the switch is opened (either during the period in which valve is held open or closed, or during de-energizing of coil after the valve operation), the freewheel current from the actuator is conducted through the freewheel current pathway (e.g., through freewheel diode 322). The freewheel current is circulated via the freewheel current pathway to one of the voltage supply/energy storage devices 330, 340 or 350.

Referring still to FIG. 3, the valve actuation subsystems 312 may be configured in boost configurations or buck configurations. Referring first to valve actuation subsystems 312*a* and 312*b*, those subsystems are arranged in a boost configuration. Specifically, energization of the actuators 314*a*, 314*b* and resulting freewheel currents cause energy from energy storage device 330 to boost the energy in energy storage device 340.

Referring particularly to valve actuation subsystem 312*a*, the actuator is energized by first closing switch 318*a*. The voltage applied from supply 332 cause an increasing current to be driven through actuator 314*a* and switch 318*a*, since the actuator and switch are coupled in series between supply 332 and a ground voltage. At a desired current level, the switch begins to open and close rapidly based on current-sense and PWM control signals applied to supply 320*a*. This causes the current to decrease and increase in the neighborhood of the desired current level, in order to substantially maintain a desired holding force or opening or closing force for the valve.

When the switch is open, freewheel diode 322*a*, which is coupled with actuator 314*a* in series between supply 332 and capacitor 340, provides a freewheel current path. The freewheel current path allows freewheel current from actuator 314*a* to circulate to capacitor 340, in order to charge up or maintain a desired charge on the capacitor. Freewheel current is dumped to capacitor 340 through freewheel diode 322*a* while the valve is being held open or closed (i.e. while switch 318*a* is open during the period in which the switch is opening and closing rapidly), and during the de-energization of the actuator (e.g., as the valve is released from being held open or closed). For example, as valve 212 is released from the fully closed position of FIG. 2A, upper coil 216 would circulate a freewheel current during the period of de-energization. Where coil 216 is configured as a stage 1 boost driver in system 310, this freewheel current could be dumped to capacitor 340. Valve actuation subsystem 312*b* operates similarly in a boost mode, so as to dump freewheel current to capacitor 340.

Valve actuation subsystems 312*c* and 312*d* are buck configurations, relative to capacitor 340, in that capacitor 340 acts as a voltage source for energizing actuators 314*c* and 314*d*. Referring particularly to subsystem 312*c*, when switch 318*c* is first closed to energize actuator 314*c* and initiate the valve operation (e.g., opening or closing), current rises through actuator 314*c* because of the voltage drop between capacitor 340 and the supply voltage at capacitor 334. While the valve is being held open or closed, switch 318*c* opens and closes, so that current is alternately conducted through switch 318*d* and a freewheel current path containing freewheel diode 322*c*. The freewheel path allows freewheel current from actuator 314*c* to circulate back to energy storage device 330 (e.g., to charge up and/or maintain the charge on capacitor 334).

Valve actuation subsystems 312*e*, 312*f*, 312*g* and 312*h* are coupled within a second stage of system 310, which operates on a regulated voltage drop between capacitor 350 and capacitor 340. For example, as discussed above, capacitor 350 may be selected to charge to 84 volts during normal operation, with capacitor 340 selected to charge to 42 volts.

Valve actuation subsystems 312*e* and 312*f* are configured as boost subsystems, relative to capacitor 340. Specifically, freewheel current from actuators 314*e* and 314*f* is conducted through freewheel diodes 322*e*, 322*f* to charge up and/or maintain the charge on capacitor 350. Capacitor 340 acts as a voltage source for the stage 2 boost actuators, which are energized upon closing of switches 318*e* and 318*f*. Opening of the switches allows the freewheel current to circulate to capacitor 350.

Valve actuation subsystems 312*g* and 312*h* are configured as buck subsystems, relative to capacitor 350. The charge built up on capacitor 350 enables it to act as a voltage supply to energize actuators 314*g* and 314*h* upon closing of switches 318*g* and 318*h*. While the corresponding valve is being held open or closed, current conducts through the actuators 314*g* and 314*h* via the energizing/charging current path (e.g., through switches 318*g* and 318*h*) when the switches are closed, and via the freewheel path (e.g., through freewheel diodes 322*g* and 322*h*) when the switches are open. Operation of these stage 2 buck drivers results in energy transfer from capacitor 350 to capacitor 340.

To summarize the boost-buck characteristics of system 310, actuators 314*a* and 314*b* are configured as boost drivers, which supply freewheel current to capacitor 340, thus charging up capacitor 340. Actuators 314*c* and 314*d* are configured as buck drivers, which return current (stored energy) from capacitor 340 back to capacitor 334. Stage 1 therefore stores energy in capacitor 340 during the operating cycles of actuators 314*a* and 314*b*, and returns that stored energy back to the power supply during the operating cycles of buck actuators 314*c* and 314*d*. Similarly, stage 2 stores energy in capacitor 350 as a result of the operating cycles of boost actuators 314*e* and 314*f*, and that stored energy is returned to the power supply (e.g., capacitor 340) during the operating cycles of buck actuators 314*g* and 314*h*.

Accordingly, it will be appreciated that in a given stage, the components that create the regulated voltage drop across the stage can act as a voltage source to drive actuators, or as a recipient of actuator charging currents and/or freewheel currents. Power supply 332 and capacitor 334 act as a voltage source to drive current through boost actuators 314*a* and 314*b*, and as a recipient of current from actuators 314*c* and 314*d*. Capacitor 340 is a recipient of current from the stage 1 boost actuators and stage 2 buck actuators, and a source for the stage 1 buck actuators and stage 2 boost actuators. Capacitor 350 is a recipient for the stage 2 boost actuators and a source for the stage 2 buck actuators.

Figure 4:
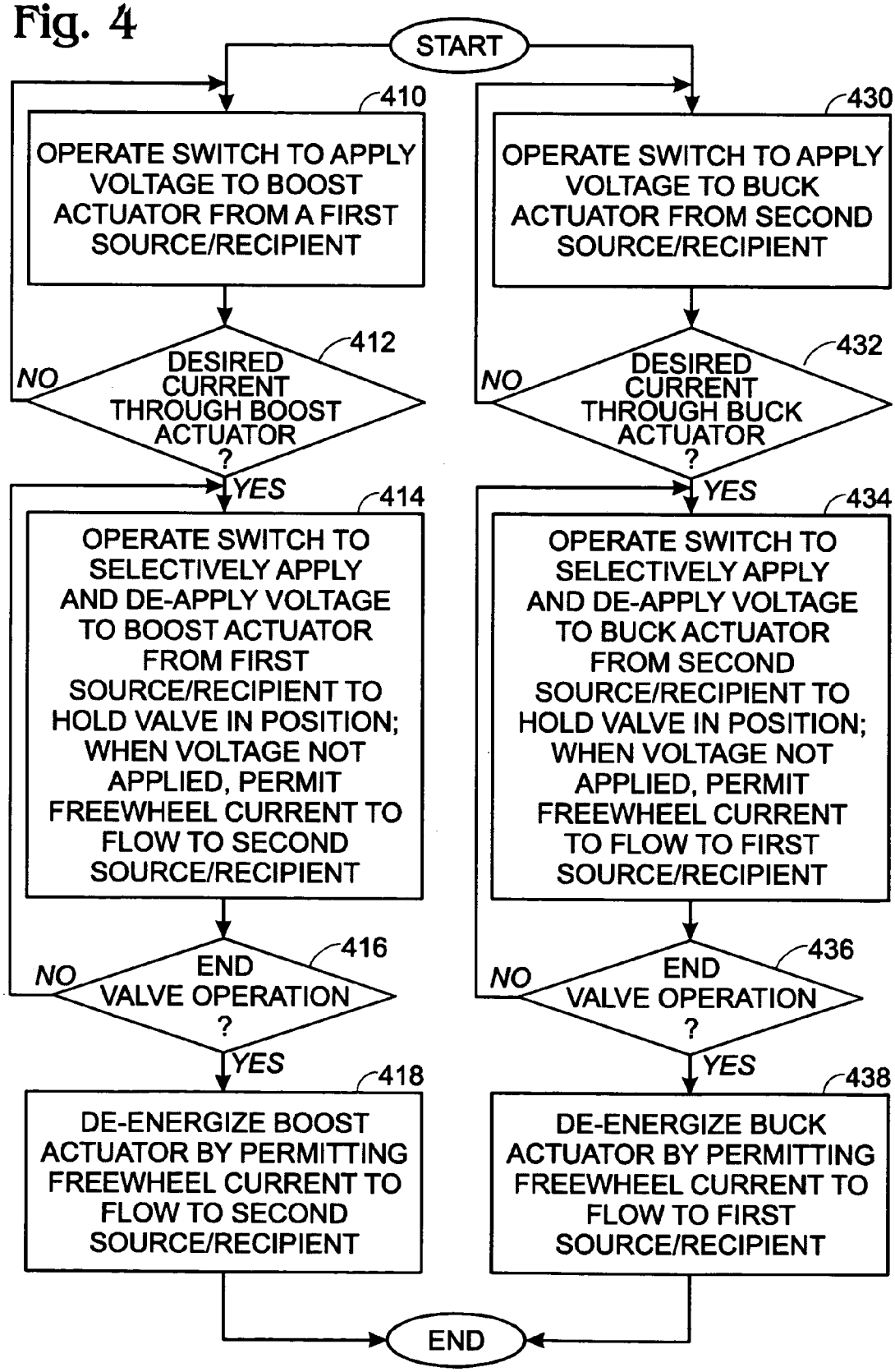
FIG. 4 is a flowchart depiction of an exemplary method for electronically controlling valve actuation.

An exemplary method of EVA control which employs such a boost and buck scheme is depicted in FIG. 4. Steps 410 through 418 describe operation of a boost actuator connected between first and second components, each of which is configured to act as a source of voltage to drive current through an actuator coil, and/or a recipient of actuator current. Steps 430 through 438 describe operation of a buck actuator connected between those same two components. The boost and buck actuators may be operated simultaneously, or in any desired sequence, and may be used to control the same valve, or different valves.

At 410, the method includes operating a switch to apply voltage to a boost actuator from a first source/recipient. The voltage is applied until a desired current through the boost actuator is achieved, as shown at step 412. At 414, the controlled valve is held in position by regulating the valve current (e.g., through PWM control of the switch to selectively apply and de-apply the source voltage). Freewheel current is permitted to circulate from the boost actuator to a second source/recipient when the voltage is not applied. As seen at steps 416 and 418, the actuator is de-energized by permitting remaining freewheel current to flow from the actuator to the second source/recipient.

At 430, the buck actuator is energized by operating a switch to apply voltage to the buck actuator from the second/source recipient. After a desired actuator current is first reached (step 432), current through the actuator is regulated to hold the controlled valve in position (step 434), however freewheel current flows from the buck actuator back to the first source/recipient (step 434), which acted as a source in steps 410–418 to drive the boost actuator. As seen in steps 436 and 438, when the valve operation completes, the buck actuator is de-energized by permitting remaining freewheel current to circulate back to the first source/recipient.

Combinations of boost and buck actuators can be used to produce desired balanced voltages throughout system 310. In certain implementations, selecting the same valves for boost and buck in each stage creates a balanced boost and buck load, with the exception of losses in the coil and semiconductors. The losses may be made up by increasing the current in the boost circuit to compensate for the losses or by utilizing a de-energized actuator coil to boost added energy into capacitors 340 and 350.

The examples discussed herein require only a single switch and freewheel diode per actuator (though in an alternate embodiment more may be used), and it is thus believed that significant cost advantages may be obtained over prior systems. The exemplary systems discussed herein also provide a low loss method of capturing freewheel actuator current without added components. Also, in multiple stage implementations, the stages can provide a regulated voltage for actuator drive. The use of such a regulated differential voltage across each stage can be used to provide a more constant electromotive force, and a more constant switch duty cycle over the engine operating/driving cycle.

Also, certain multiple stage implementations may reduce the number of components needed to measure actuator currents. In the example of FIG. 3, the combination of eight actuator coils into a two stage design allows current sensing to be performed with only four current sense resistors (362, 364, 366 and 368). Currents within relevant branches may then be determined by controller 12 or controller 234 using loop laws.

It should be appreciated that an EVA system may be constructed according to the present description to have more or less than four valve actuators per stage, and/or with a single stage or three or more stages. In certain settings, increasing the number of actuators in a given stage or providing additional stages will provide more opportunities to use normal valve actuation events (e.g., opening or closing of valves) to maintain desired charge levels (e.g., voltages) at capacitances 334, 340 and 350. Accordingly, there would be less need to energize or de-energize a coil independent of a normal valve event in order to maintain desired voltages across the stages.

Also, for a given engine cylinder arrangement, actuators 314 may be provided in various configurations. Actuators 314 may be used to control intake or exhaust valves of the cylinder, and may be employed on cylinders having any number of valves. In some embodiments, intake valves may be operated with EVA systems as discussed above, with the exhaust valves being mechanically actuated through operation of a cam or like device. In such a configuration, variable or adjustable cam timing may be employed with the mechanically actuated exhaust valves.

In the EVA systems of the present description, a single actuator may be used for each valve, two actuators may be employed as in the two-coil arrangement of FIGS. 2A and 2B, or more than two actuators may be used per valve. Typically, all the actuators for a given cylinder are co-located so that they are close or adjacent to one another in the control circuit (e.g., in adjacent actuation subsystems in one of the stages of system 310). Co-locating the actuators can reduce interference and losses that may occur with lengthy circuit loops.

This concludes the description of the invention. The reading of it by those skilled in the art would bring to mind many alterations and modifications without departing from the spirit and the scope of the invention. Accordingly, it is intended that the scope of the invention be defined by the following claims:

What is claimed is:

1. A system for electronically actuating valves in an internal combustion engine, comprising:

a first voltage source;

a second voltage source; and plural valve actuator subsystems coupled between the first voltage source and the second voltage source, each valve actuator subsystem having a valve actuator and a switch, where the switch and the valve actuator of one of the valve actuator subsystems are configured so that current flows from the first voltage source through the valve actuator when the switch is in a first position, and when the switch is in a second position, current is permitted to flow from the valve actuator toward the second voltage source, and where the switch and the valve actuator of another of the valve actuator subsystems are configured so that current flows from the second voltage source through the valve actuator when the switch is in a first position, and when the switch is in a second position, current is permitted to flow from the valve actuator toward the first voltage source.

2. The system of claim 1, where the second voltage source includes a capacitor, the capacitor being selected to charge to a voltage higher than a voltage of the first voltage source.

3. The system of claim 2, where for said one of the valve actuator subsystems, the valve actuator and switch are coupled in series between the first voltage source and a ground voltage, and where for said another of the valve actuation subsystems, the valve actuator and switch are coupled in series between the second voltage source and the first voltage source.

4. The system of claim 1, where for each valve actuator subsystem, the valve actuator subsystem further includes a freewheel diode configured to permit freewheel current to circulate from the valve actuator to one of the first voltage source and the second voltage source upon opening of the switch.

5. The system of claim 4, where for each valve actuator subsystem, the switch and the freewheel diode provide alternate pathways for current flowing through the valve actuator, the alternate pathways being selected based on whether the switch is opened or closed.

6. The system of claim 1, where for said one of the valve actuator subsystems, the valve actuator and switch are coupled in series between the first voltage source and a ground voltage, and where for said another of the valve actuation subsystems, the valve actuator and switch are coupled in series between the second voltage source and the first voltage source.

7. The system of claim 1, further comprising:

a third voltage source; and plural valve actuation subsystems coupled between the second voltage source and the third voltage source, each including a valve actuator and a switch, where the switch and the valve actuator of one of the valve actuator subsystems coupled between the second voltage source and the third voltage source are configured so that current flows from the second voltage source through the valve actuator when the switch is in a first position, and when the switch is in a second position, current is permitted to flow from the valve actuator toward the third voltage source, and where the switch and the valve actuator of another of the valve actuator subsystems coupled between the second voltage source and the third voltage source are configured so that current flows from the third voltage source through the valve actuator when the switch is in a first position, and when the switch is in a second position, current is permitted to flow from the valve actuator toward the second voltage source.

8. The system of claim 7, where the second and third voltage sources are energy storage devices including capacitors, the system being adapted so that during operation, the third voltage source is at a higher voltage than the second voltage source, which is at a higher voltage than the first voltage source.

9. An internal combustion engine, comprising:

a plurality of cylinders, each having one or more valves that are selectively openable and closable; and a system for electronically actuating the valves, the system including:

a first voltage source;

a second voltage source; and plural valve actuator subsystems coupled between the first voltage source and the second voltage source, each valve actuator subsystem having a valve actuator and a switch, where the switch and the valve actuator of one of the valve actuator subsystems are configured so that current flows from the first voltage source through the valve actuator when the switch is in a first position, and when the switch is in a second position, current is permitted to flow from the valve actuator toward the second voltage source, and where the switch and the valve actuator of another of the valve actuator subsystems are configured so that current flows from the second voltage source through the valve actuator when the switch is in a first position, and when the switch is in a second position, current is permitted to flow from the valve actuator toward the first voltage source.

10. The engine of claim 9, where the second voltage source includes a capacitor, the capacitor being selected to charge to a voltage higher than a voltage of the first voltage source.

11. The engine of claim 10, where for said one of the valve actuator subsystems, the valve actuator and switch are coupled in series between the first voltage source and a ground voltage, and where for said another of the valve actuation subsystems, the valve actuator and switch an coupled in series between the second voltage source and the first voltage source.

12. The engine of claim 9, where for each valve actuator subsystem, the valve actuator subsystem further includes a freewheel diode configured to permit freewheel current to circulate from the valve actuator to one of the first voltage source and the second voltage source upon opening of the switch.

13. The engine of claim 12, where for each valve actuator subsystem, the switch and the freewheel diode provide alternate pathways for current flowing through the valve actuator, the alternate pathways being selected based on whether the switch is opened or closed.

14. The engine of claim 9, where for said one of the valve actuator subsystems, the valve actuator and switch are coupled in series between the first voltage source and a ground voltage, and where for said another of the valve actuation subsystems, the valve actuator and switch are coupled in series between the second voltage source and the first voltage source.

15. The engine of claim 9, further comprising:

a third voltage source; and plural valve actuation subsystems coupled between the second voltage source and the third voltage source, each including a valve actuator and a switch, where the switch and the valve actuator of one of the valve actuator subsystems coupled between the second voltage source and the third voltage source are configured so that current flows from the second voltage source through the valve actuator when the switch is in a first position, and when the switch is in a second position, current is permitted to flow from the valve actuator toward the third voltage source, and where the switch and the valve actuator of another of the valve actuator subsystems coupled between the second voltage source and the third voltage source are configured so that current flows from the third voltage source through the valve actuator when the switch is in a first position, and when the switch is in a second position, current is permitted to flow from the valve actuator toward the second voltage source.

16. The engine of claim 15, where the second and third voltage sources are energy storage devices including capacitors, the system being adapted so that during operation, the third voltage source is at a higher voltage than the second voltage source, which is at a higher voltage than the first voltage source.

17. A system for electronically actuating valves in an internal combustion engine, comprising:

a power supply;

an energy storage device; and plural valve actuator subsystems coupled to the power supply and energy storage device, each valve actuator subsystem having a valve actuator, a switch coupled within a charging current pathway, and a freewheel current pathway, where at least one of the valve actuator subsystems is arranged in a boost configuration, in which current generated by the valve actuator in response to voltage applied from the power supply is conducted through the freewheel current pathway to the energy storage device when the switch is in a first position, and where another of the subsystems is arranged in a buck configuration, in which current generated by the valve actuator in response to voltage applied from the energy storage device is conducted through the freewheel current pathway back to the power supply when the switch is in a first position.

18. The system of claim 17, where the energy storage device includes a capacitor adapted to charge to an operating voltage, which is higher than a voltage of the power supply.

19. The system of claim 18, where for each valve actuator subsystem arranged in a boost configuration, the valve actuator and the switch are coupled in series between the power supply and a ground voltage, and where for each valve actuator subsystem arranged in a buck configuration, the valve actuator and the switch are coupled in series between the energy storage device and the power supply.

20. The system of claim 18, where for each valve actuator subsystem arranged in a boost configuration, the valve actuator and the switch are coupled in series between the power supply and a ground voltage, and the valve actuator and a freewheel diode are coupled in series between the power supply and the energy storage device.

21. The system of claim 18, where for each valve actuator subsystem arranged in a buck configuration, the valve actuator and the switch are coupled in series between the energy storage device and the power supply, and the valve actuator and a freewheel diode are coupled in series between the power supply and a ground voltage.

22. The system of claim 18, where for each valve actuator subsystem arranged in a boost configuration, the valve actuator and the switch are coupled in series between the power supply and a ground voltage, and the valve actuator and a freewheel diode are coupled in series between the power supply and the energy storage device, and where for each valve actuator subsystem arranged in a buck configuration, the valve actuator and the switch are coupled in series between the energy storage device and the power supply, and the valve actuator and a freewheel diode are coupled in series between the power supply and the ground voltage.

23. A system for electronically actuating cylinder valves in an internal combustion engine, comprising:

a power supply;

an energy storage device; and plural valve actuator subsystems coupled to the power supply and the energy storage device, where each valve actuator subsystem includes:

an actuator, a freewheel diode; and a switch coupled with the actuator and freewheel diode and configured so that, when the actuator is energized via voltage applied from one of the power supply and the energy storage device, an open or closed state of the switch determines whether actuator current flows through the actuator and the switch, or through the actuator and the freewheel diode, where the plural valve actuator subsystems are configured so that actuator energization and dissipation of freewheel current is performed independently of any switching other than operation of the switch included in each of the plural valve actuator subsystems, where at least one of the valve actuator subsystems is configured in a boost configuration, in which the actuator is energized via voltage applied from the power supply when the switch is in a first position, and in which current circulates from the actuator to the energy storage device when the switch is in a second position, and where at least one of the valve actuator subsystems is configured in a buck configuration, in which the actuator is energized via voltage applied from the energy storage device when the switch is in a first position, and in which current circulates from the actuator to the power supply when the switch is in a second position.

24. The system of claim 23, where the energy storage device includes a capacitor.

* * * * *